US008720021B2

(12) United States Patent
Takahashi

(10) Patent No.: US 8,720,021 B2
(45) Date of Patent: May 13, 2014

(54) METHOD FOR INCREASING THICKNESS OF NON-WOVEN FABRIC AND APPARATUS FOR IMPLEMENTING THE SAME

(75) Inventor: Tatsuo Takahashi, Kagawa (JP)

(73) Assignee: Uni-Charm Corporation, Shikokuchuo-Shi, Ehime (JP)

( * ) Notice: Subject to any disclaimer, the term of this patent is extended or adjusted under 35 U.S.C. 154(b) by 258 days.

(21) Appl. No.: 13/125,159

(22) PCT Filed: Oct. 19, 2009

(86) PCT No.: PCT/JP2009/067975

§ 371 (c)(1), (2), (4) Date: Apr. 20, 2011

(87) PCT Pub. No.: WO2010/047292

PCT Pub. Date: Apr. 29, 2010

(65) Prior Publication Data

US 2011/0191994 A1 Aug. 11, 2011

(30) Foreign Application Priority Data

Oct. 20, 2008 (JP) ..... 2008-269524

(51) Int. Cl.
*D06C 7/00* (2006.01)
*D06B 1/02* (2006.01)

(52) U.S. Cl.
USPC ..... 28/167

(58) Field of Classification Search
CPC ..... D04H 1/492; D04H 1/498; D04H 1/50; D04H 3/11; D06C 2700/13; D06C 7/00; D06B 1/02; D06B 5/08; D06B 19/00; D06B 23/04
USPC ..... 28/167, 104, 105, 166; 68/5 R, 7, 8, 5 B, 68/5 D, 222; 8/149.1, 149.3
See application file for complete search history.

(56) References Cited

U.S. PATENT DOCUMENTS 3,042,576 A * 7/1962 Harmon et al. ..... 162/114
3,458,905 A 8/1969 Dodson, Jr. et al.

(Continued)

FOREIGN PATENT DOCUMENTS

JP 6045662 A 3/1985
JP 535856 U 5/1993

(Continued)

OTHER PUBLICATIONS

European Search Report dated Feb. 1, 2013.
Iternational Search Report for Application No. PCT/JP2009/067975, issued Oct. 30, 2009.

*Primary Examiner* — Amy Vanatta
(74) *Attorney, Agent, or Firm* — Lowe Hauptman & Ham, LLP

(57) ABSTRACT

The present invention utilizes jet streams of hot gas at a high efficiency and thereby to increase a bulk of non-woven fabric. Non-woven fabric containing thermoplastic synthetic fibers is subjected to jet streams of hot gas in a thickness direction of the non-woven fabric. A temperature of the jet streams of hot gas used for this process is set to a level lower than the temperature at which a resinous ingredient forming the surface of the thermoplastic begins to be melted. The jet streams of hot gas are directed to penetrate fiber interstices in the non-woven fabric and then to strike on a means serving to divert the jet streams of hot gas.

15 Claims, 10 Drawing Sheets

(56) References Cited

U.S. PATENT DOCUMENTS

| | | | | |
|---|---|---|---|---|
| 5,143,779 | A * | 9/1992 | Newkirk et al. | 428/218 |
| 5,368,925 | A * | 11/1994 | Hosokawa et al. | 442/359 |
| 7,131,171 | B2 * | 11/2006 | Miyamoto et al. | 28/166 |
| 7,562,425 | B2 * | 7/2009 | Taniguchi et al. | 28/104 |
| 2004/0111848 | A1 | 6/2004 | Miyamoto et al. | |
| 2011/0126388 | A1 * | 6/2011 | Takabayashi et al. | 28/104 |

FOREIGN PATENT DOCUMENTS

| | | | |
|---|---|---|---|
| JP | 2003339761 | A | 12/2003 |
| JP | 2004137655 | A | 5/2004 |
| WO | 1403413 | A1 | 3/2004 |

* cited by examiner

METHOD FOR INCREASING THICKNESS OF NON-WOVEN FABRIC AND APPARATUS FOR IMPLEMENTING THE SAME

RELATED APPLICATIONS

The present application is national phase of PCT/JP2009/067975 filed Oct. 19, 2009, and claims priority from, Japanese Application Number 2008-269524, filed Oct. 20, 2008.

1. Technical Field

The present invention relates to methods and apparatuses adapted to apply jet streams of hot gas to a non-woven fabric and thereby to increase a thickness of the non-woven fabric.

2 . Related Art

It is well known that bulky non-woven fabrics made of thermoplastic synthetic fibers have their thickness decreased under a load in a thickness direction for a long period. It is also well known that such a non-woven fabric having the decreased thickness may be heated by, for example, applying hot gas such as hot air to this non-woven fabric to increase or recover its thickness. Recovery of the thickness may be generally referred to as recovery of bulk of the non-woven fabric.

For example, JP 2003-339761 A (PATENT DOCUMENT 1) discloses a method according to which not air is applied to an air-through non-woven fabric made of thermoplastic synthetic fibers and taken up in the form of a roil and thereby the initial balk (thickness) of this non-woven fabric is recovered.

JP 2004-137655 A (PATENT DOCUMENT 2) discloses a method according to which hot air at a temperature lower than the melting point of a thermoplastic fiber but not lower than this melting point minus 50° C. is applied in an air-through fashion to a non-woven, fabric containing crimped thermoplastic synthetic fibers after the non-woven fabric taken up in the form of a roll has been unrolled, and thereby the bulk of this non-woven fabric is recovered.

PRIOR ART DOCUMENT

Patent Document 1 JP 2 003-339761 A
Patent Document 2 JP 2 004-137655 A.

SUMMARY OF THE INVENTION

Problem to be Solved by the Invention

According to the method for increasing a thickness of non-woven fabrics disclosed in PATENT DOCUMENTS 1 and 2, hot air is blasted on the non-woven fabric. An object of the present invention is to improve such prior art so that jet streams of hot gas may be used effectively.

Measure to Solve the Problem

The present invention includes first and second aspects thereof.

The first aspect of the present invention relates to a method tor increasing a thickness of a non-woven fabric, wherein the method comprises the stops of; feeding a web of non-woven fabric in a machine direction, wherein the non-woven fabric is formed of a mass of thermoplastic synthetic fibers entangled one with another and having a transverse direction, a longitudinal direction and a thickness direction being orthogonal one to another and upper and lower surfaces opposite to each other in the thickness direction and extending in the transverse direction as well as in the longitudinal direction; and applying first jet streams of hot gas in the thickness direction to the web of non-woven fabric in a course of being fed in the machine direction to increase the thickness of the non-woven fabric.

The present invention on the first aspect thereof is described below. A temperature of the first jet streams of hot gas is lower than a temperature at which thermoplastics forming a surface of the thermoplastic synthetic fibers begin to melt. The step of applying the first jet streams of hot gas further comprises the following secondary steps: a step of heating the non-woven fabric by applying the first jet streams of hot gas to one surface of the upper and lower surfaces of the non-woven fabric in a single direction so that the first jet streams of hot gas penetrate fiber interstices formed of mass of thermoplastic synthetic fibers; and a step of striking the first jet streams of hot gas against a means adapted to divert pathways of the first jet streams of hot gas to reflect the first jet streams of hot gas and make the jet streams of hot gas heat the non-woven fabric further and thereby to increase the thickness of the non-woven fabric.

According to one embodiment of the invention on the first aspect thereof, the means used to divert the pathways of the first jet streams of hot gas comprises one of an air-impervious fixed, plate slidably supporting the web of the non-woven fabric from the lower surface thereof in the machine direction, an air-impervious belt being movable in the machine direction together with the web of non-woven fabric supported thereon and an air-impervious peripheral surface of a roll adapted to rotate in one direction.

According to another embodiment of the invention on the first aspect thereof, the means used to divert the pathways of the first jet streams of hot gas is defined by second jet streams of hot gas applied to the surface opposed to the one surface to which by the first jet streams of hot gas applied.

According to still another embodiment of the invention on the first aspect, thereof, the first jet streams of hot gas are one of those of dry air or water steam.

According to still another embodiment of the invention on the first aspect thereof, the web of the non-woven fabric is fed from a source of the non-woven fabric taken up in a form of a roll.

According to still smother embodiment of the invention on the first aspect thereof, the temperature of the first jet streams of hot gas is between a melting temperature of the thermoplastics forming the surface of the non-woven fabric and the temperature lower than the melting temperature by 30° C.

According to yet another embodiment of the invention on the first aspect thereof, the first jet streams of hot gas are directed obliquely toward the one surface of the non-woven fabric and toward upstream in the machine direction and the second jet streams of hot gas are directed obliquely toward the other one surface of the non-woven fabric and toward upstream in the machine direction.

The second aspect of the present invention relates to an apparatus for implementing the method by one of the two modes of construction as defined below by (1) and (2);

(1) a construction comprising a means to divert pathways of first jet streams of hot gas formed, of one of an air-impervious fixed plate slidably supporting the non-woven fabric from the lower surface thereof, an air-impervious belt being movable in the machine direction together with the non-woven fabric supported thereon and an air-impervious peripheral surface of a roll adapted to rotate in one direction, and first jet nozzles to apply the first jet streams of hot gas to the non-woven fabric supported by one of the fixed plate, the belt and the air impervious peripheral surface of the roll and thereby to make the first jet streams of hot gas strike against the means; and (2) a construction comprising first and second roll pairs spaced from each other in the machine direction and serving to feed the non-woven, fabric in the machine direction and, further comprising, between the first and second roll pairs, first jet nozzles to apply first jet streams of not gas to one surface of the upper and lower surfaces of the non-woven fabric and second jet nozzles to apply second jet streams of hot gas to the surface opposed to the one surface wherein a direction in which the first jet nozzles extend and a direction in which the second jet nozzles extend are set up so as to make the first jet streams of hot gas and the second, jet streams of hot gas come into collision with each other within the non-woven fabric.

According to one embodiment of the invention on the second aspect thereof, the distance between the first jet nozzles and one of the air-pervious fixed plate, the air-pervious belt and the air-pervious peripheral surface of the roil is gradually increased toward the downstream in the machine direction.

According to another embodiment of the invention on the second aspect thereof, one of the air-pervious fixed plate the air-pervious belt and the air-pervious peripheral surface of the roll is heated independently.

According to still another embodiment of the invention or the second, aspect thereof, one of the air-pervious fixed plate, the air-pervious belt and the air-pervious peripheral surface of the roll has a surface describing a zigzag line in a sectional, view taken in the machine direction.

According to still another embodiment of the invention on the second aspect thereof, the first jet nozzles have one of an arrangement of aligning a plurality of circular jet nozzles locating in the machine direction and an arrangement of aligning a plurality of circular jet nozzles locating in the machine direction as well as in the cross direction orthogonal to the machine direction.

According to yet another embodiment of the invention on the second aspect thereof, the first jet nozzles are one of nozzles shaped as long openings extending in the machine direction in parallel one with another and nozzles shaped as long openings extending in the cross direction orthogonal to the machine direction in parallel one with another.

Effect of the Invention

According to the method provided by the present invention on its first aspect, the first jet streams of hot gas applied to the non-woven fabric in one direction strike on a means to divert pathways of the first jet streams of hot gas so that the diverted, i.e., the reflected jet streams of hot gas may further heat the non-woven fabric. In this way, a utilization efficiency of the first jet streams of hot gas is significantly improved in comparison with the prior art wherein non-woven fabric is heated only when jet streams of hot gas penetrate the non-woven fabric.

According to the apparatus provided by the present invention on its second aspect, the first jet streams of hot gas applied from the first jet nozzles to the non-woven fabric in one direction strikes on one of the air-impervious fixed plate, other means supporting the non-woven fabric thereon and the first jet streams of hot gas are brought in collision with the second jet streams of hot gas from the second jet nozzles. In this way, the first jet streams of hot gas can divert the pathways thereof and heat the non-woven fabric once again.

DETAILED DESCRIPTION OF THE PREFERRED EMBODIMENTS

Details of the present invention relating to a method and an apparatus for increasing a thickness of a non-woven fabric will be more fully understood from the description given hereunder with reference to the accompanying drawings.

Figure 1:
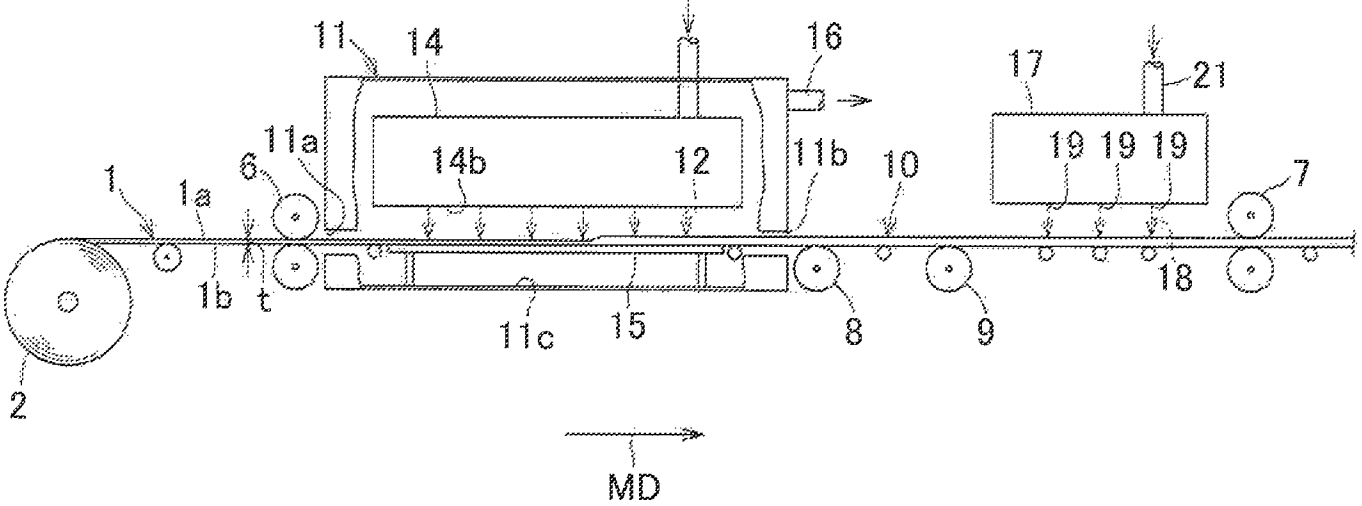
FIG. 1 is a diagram exemplarily illustrating a process of heat-treatment of a web of non-woven fabric.

FIG. 1 is a diagram exemplarily illustrating a process of heat-treatment of a non-woven fabric by using a method and an apparatus according to the present invention. On the left hand in FIG. 1, there is a web of non-woven fabric 1 prepared in the form of a roll 2 and, from this roil 2, the non-woven fabric 1 is continuously drawn forth in a machine direction MI) by first and second nip roil pairs 6, 7 cooperating with first and second feed rolls 8, 3 and the other feed rolls optionally used with these rolls 6, 7, 8, 9. After having passed through the first nip roll pair 6, the non-woven fabric 1 is introduced into a heat-treatment chamber 11 illustrated in FIG. 1 as partially cutaway. The heat-treatment chamber 11 has an inlet 11*a* and an outlet 11*b* both for the non-woven fabric 1 and includes therein a hot gas jet unit 14 provided with a plurality of jet nozzles 13 (See FIG. 2) adapted to apply (eject) jet streams of hot gas 12 to the upper surface 1*a* of the non-woven fabric 1. The hot gas jet unit 14 is in fluid-communication with a hot gas source (not shown) provided outside the neat-treatment chamber 11. Below the hot gas jet unit 14, there is a reflector plate 15 fixed to a floor 11*c* of the heat-treatment chamber 11 and the non-woven fabric 1 is transported on this reflector plate 15. More specifically, the non-woven fabric 1 moves with its lower surface 1*b* sliding on the reflector plate 15 and, in the course of moving on the reflector plate 15, the non-woven fabric 1 is subjected to ejections of the jet streams of hot gas 12, The non-woven fabric 1 is heated by the ejections of the jet streams of hot gas 12 and a thickness t thereof is gradually increased as it moves in the machine direction MD within the chamber 11 until the non-woven fabric 1 obtains a desired thickness for the heat-treated non-woven fabric 10 when it exits from the beat-treatment chamber 11. The heat-treatment chamber 11 is provided with a duct 16 serving to the ejections of the jet streams of hot gas 12 from the chamber 11.

The non-woven fabric 10 having left the outlet 11*b* of the heat-treatment chamber 11 is then transported in the machine direction ME) so as to pass through a region defined below a cold air jet unit 17. The unit 17 comprises a plurality of cold air jet nozzles 19 adapted to eject cold air 18 for the purpose of cooling the non-woven fabric 10 to a room temperature and a duct 21 in fluid-communication with a source of cold air (not shown). After having passed below the unit 17, the non-woven fabric 10 is transported by a second, nip roll pair 7 to a next step, for example, of making menstruation napkins (not shown). Intended use of the non-woven fabric 10 is not specified, and, for example, in the process of making menstruation napkins, the non-woven fabric 10 may be worked so as to be used as a liquid-pervious top-sheet of the napkin and the like.

Such process as illustrated in FIG. 1 can be effectively used for the non-woven fabric 1 which, contains thermoplastic synthetic fibers 20 (See FIG. 2) and, for example, has been left as it is taken up in the form of a roll for a long period during which the thickness t of the non-woven fabric has been reduced, with respect to its initial thickness t at the time of manufacturing, since this process may promote such non-woven fabric 1 to increase its thickness t or to regain its initial thickness t. Specifically, in the process illustrated in FIG. 1, the non-woven fabric 1 has its thickness t still smaller than the initial thickness immediately after it has been drawn forth from the roll 2. However, when the non-woven fabric 1 is introduced into the heat-treatment chamber 11 and subjected to ejections of the jet streams of hot gas 12 as the web 1 is transported on the reflector plate 15, thermoplastic synthetic fibers 20 constituting the non-woven fabric 1 which has been deformed under compression are now heated and tend to regain its initial shape. As a consequence, the non-woven fabric 1 leaving the heat-treatment chamber 11, i.e., the web of non-woven fabric designated by reference numeral 10 in FIG. 1 has a thickness larger than that of the non-woven fabric 1 before it has been introduced into the heat-treatment chamber 11, The ejections of cold air 18 supplied from the cold air jet nozzles 19 serve to cool the thermoplastic synthetic fibers 20 which is easily deformable at a high temperature and thereby to make the web of non-woven fabric 10 deformation-resistant. It should be appreciated that the non-woven fabric 1 has a transverse direction, a longitudinal direction and a thickness direction being orthogonal one to another. Referring to FIG. 1, the longitudinal direction corresponds to the machine direction MD and the transverse direction corresponds to the cross direction CD which is orthogonal to the machine direction MD (see FIG. 11). The upper surface 1*a* and the lower surface 1*b* of the non-woven fabric 1 are vertically spaced from each other in the thickness direction and extend, in the transverse direction as well as in the longitudinal direction.

Figure 2:
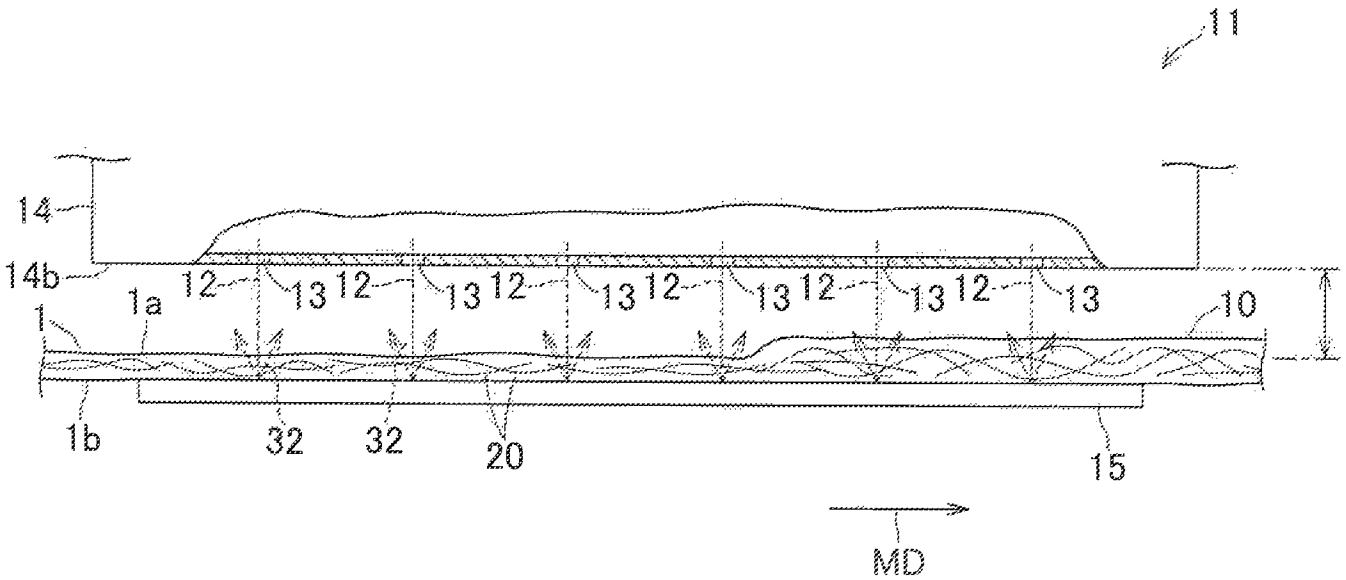
FIG. 2 is a diagram illustrating a part of FIG. 1 in an enlarged scale.

FIG. 2 is a scale-enlarged diagram illustrating the heat-treatment chamber 11 of FIG. 1 as partially cutaway, within which the non-woven fabric 1 is being subjected to ejections of the jet streams of hot gas 12. Within the heat-treatment chamber 11, some of the ejections of the jet streams of hot gas 12 supplied from, the jet nozzles 13 of the hot gas jet unit 14 strike on the thermoplastic synthetic fibers 20 making the non-woven fabric 1 and thereupon divert pathways thereof and the remaining jet streams of hot gas 12 penetrate fiber interstices (not shown) of the non-woven fabric 1 to strike on the reflector plate 15. The reflector plate 15 is formed, for example, of a metallic plate or heat-resisting rubber sheet and is air-impervious. Upon striking on the reflector plate 15, the pathways of the jet streams of hot gas 12 are diverted, and the jet streams of hot gas 12 changes to reflected jet streams of hot gas 32 which are directed from the lower surface 1*b* toward the upper surface 1*a* of the non-woven fabric 1. Compared to a heating method of so-called, air-through fashion in which a non-woven fabric is subjected to jet streams of hot gas penetrating the fabric in a single direction, the non-woven fabric 1 may be heated within the heat-treatment chamber 11 not only by the jet streams of hot gas 12 but also by the reflected jet streams of hot gas 32 as has been described above to improve a utilization efficiency of heat energy provided by the jet streams of hot gas 12 and, at the same time, to reduce a time period taken for increase or recovery of the thickness t of the non-woven fabric 1. A distance between the hot gas jet nozzles 13 and the upper surface 1*a* of the non-woven fabric 1 is preferably dimensioned to be as small as, for example, the hot gas jet nozzles 13 substantially come in contact with the upper surface 1*a* to minimize a volume of the jet streams of hot gas reflected by the upper surface 1*a*. In view of this, the distance between the hot gas jet nozzles 13 and the reflector plate 15 which is a means to divert pathways of the jet streams of hot gas 12 may be, for example in a gradual manner, increased toward the downstream In the machine direction MD.

While no particular composition of the non-woven fabric 1 well compatible with the process as illustrated in FIGS. 1 and 2 is specified, the fabric 1 preferably includes a mass of the thermoplastic synthetic fibers 20 by 60% by mass or higher. In addition, such mass of thermoplastic synthetic fibers 20 are preferably constituted by component fibers mechanically entangled one with another in a mechanical manner or under a melt-bonding effect. Examples of the non-woven fabric 1 containing such thermoplastic synthetic fibers 20 include a span-laced non-woven fabric, a span bonded non-woven fabric and a melt-bonded non-woven fabric. Particularly in the case of non-woven fabric 1 containing crimped thermoplastic synthetic fibers as the thermoplastic synthetic fibers 20, the increase or recovery of the thickness t achieved by the process illustrated in FIG. 1 is significant. The thermoplastic synthetic fibers 20 having crimps may be classified into one having crimps formed by a mechanical treatment and one having coiled crimps formed by heat-treatment eccentric core/sheath type composite fibers or side-by-side type composite fibers. Increase in the thickness t of the non-woven fabric 1 achieved by the process as illustrated in FIG. 1 depends on the temperature of the jet streams of hot gas 12 and the time period for which the non-woven, fabric 1 is heated by the jet streams of hot gas 12. In consideration of this, if it is desired to heat-treat the non-woven fabric 1 in a snort period of time, the temperature at which the non-woven fabric 1 is heat-treated should, be preferably set to a level as high as possible within a range lower than the temperature at which the thermoplastics forming the surface of the thermoplastic synthetic fiber 20 begins to melt. For example, the temperature of the jet streams of hot gas 12 may be preferably set to an intermediate temperature between. the melting temperature of the thermoplastics and the temperature lower than the melting temperature by 50° C., more preferably set to an intermediate temperature between the melting temperature of the thermoplastics and the temperature lower than the melting temperature by 30° C. The non-woven fabric 1 may contain, in addition to the thermoplastic synthetic fibers 20, natural fibers such as pulp fibers and/or semi-synthetic fibers such as rayon fibers.

It is possible to use the ejections of the jet streams of hot gas 12 based on dry air of 0.1 to 0.5 MPa. It is also possible to use jet. streams of water steam as the jet streams of not gas 12. Use of the jet streams of water steam assures it to prevent static electricity from generating in the course of heat-treatment the non-woven fabric 1. Compared to the jet streams of hot gas 12 based on the dry air, the water steam provides a sufficient amount of heat to reduce a time period for ejection of the jet streams of hot gas 12 or to shorten a travel distance of the non-woven fabric 1 within the heat-treatment chamber 11. However, it should be noted here that, when the jet streams of water steam is used for as jet streams of hot gas 12, the reflector plate 15 is preferably heated independently in order to avoid dew condensation occurring on the reflector plate 15.

Figure 3:
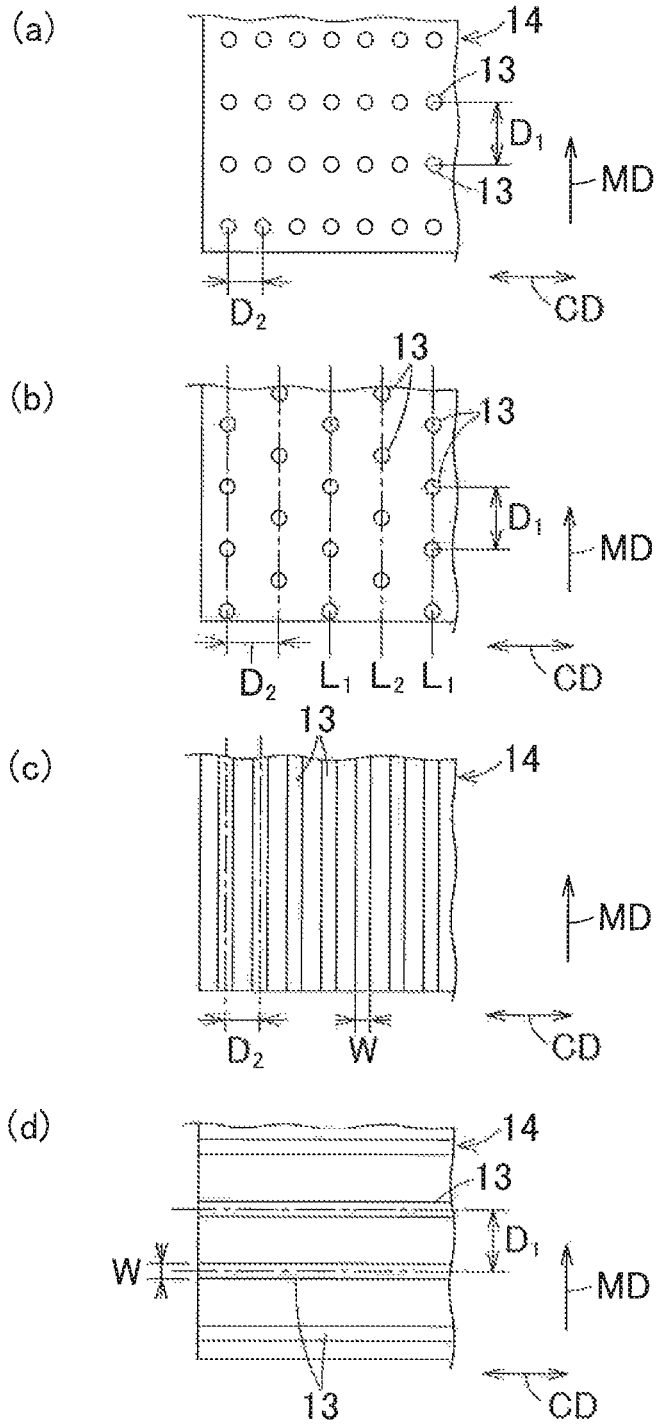
FIG. 3 illustrates exemplary embodiments (a) through (d) of jet nozzles for ejecting jet streams of hot gas.

FIG. 3 illustrates examples (a), (b), (c) and (d) of the inventive hot gas jet nozzles 13 formed in the bottom wall 14*b* of the hot gas jet unit 14 which are different one from another with respect to the shape as well as to the arrangement. Regarding the arrangement, it is requested for the non-woven fabric 1 to be subjected to the jet streams of hot gas 12 uniformly over the upper surface 1*a* without compression of the non-woven fabric 1 to much extent. To this end, the example (a) has an arrangement of aligning a plurality of circular jet nozzles 13 locating in the machine direction MD as well as in the cross direction CD orthogonal to the machine direction MD. Preferably, each of the jet nozzles 13 has a diameter in a range of 0.03 to 5 mm and center distances D1, D2 between, respective pairs of the adjacent, jet nozzles 13 in the machine direction MD and in the cross direction CD are in a range of 0.5 to 100 mm. In the example (b), there is an offset in the machine direction MD between the jet nozzles 13 of a first column L1 which are aligned in the machine direction MD and the jet nozzles 13 of a second column L2 adjacent to the first column L1. In the example (c), the jet nozzles 13 are shaped as long openings extending in the machine direction MD and in parallel one with another. In the example (d) also, the jet nozzles 13 are similar to those in the example (c) but extending in the cross direction CD. In the examples (c) and (d) of the jet nozzles 13 each comprising a plurality of long openings, each of these jet nozzles 13 has a width W preferably in a range of 0.03 to 5 mm and center distances D2, D1 between respective pairs of the adjacent jet nozzles 13 are preferably in a range of 0.5 to 100 mm. While the jet streams of hot gas 12 tends to force the non-woven fabric 1 toward the reflector plate 15 and thereby to compress the non-woven fabric 1, the reflected jet streams of hot gas 32 is directed from the lower surface 1*b* toward the upper surface 1*a* of the non-woven fabric 1, tending to force the thermoplastic synthetic fibers 20 upward and thereby to increase the bulk of the non-woven fabric 1 upward. Such effect of the reflected jet streams of hot gas 32 is significant in regions of the non-woven fabric 1 each defined between each pair of the adjacent jet nozzles 13 and, to make the most, use of such effect, the arrangement (a) or (b) of the jet nozzles 13 arranged intermittently in the machine direction MD as well as in the cross direction CD is most preferable. The arrangements depicted in (a)-(d) can be applied to embodiments depicted, in FIGS. 4-10 which will be explained later.

Figure 4:
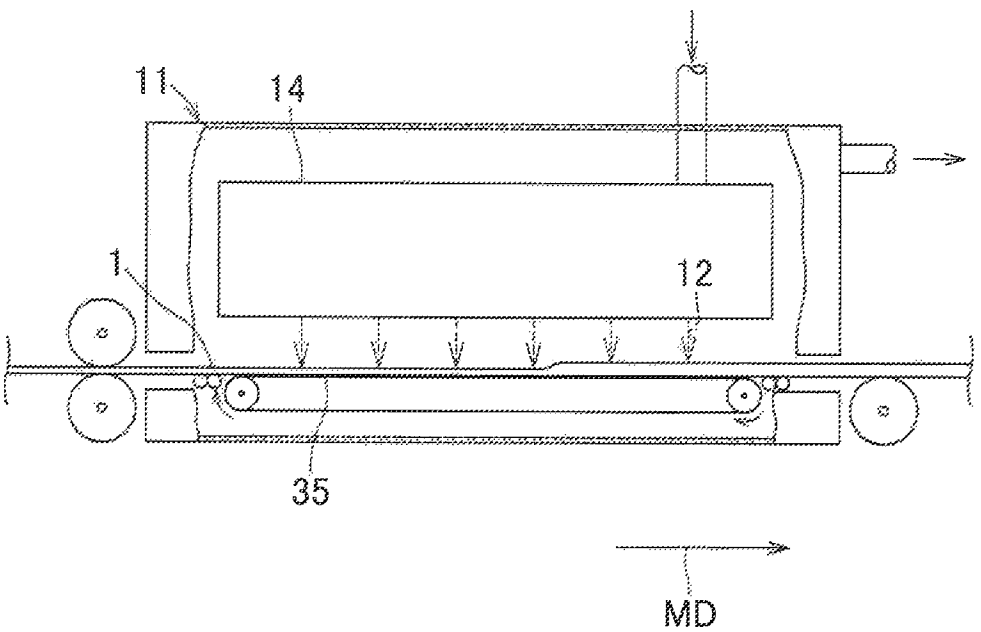
FIG. 4 is a diagram illustrating one embodiment of the heat-treatment chamber.

FIG. 4 is a diagram exemplarily illustrating one embodiment of the heat-treatment chamber 11 used to implement the present invention. In the case of this heat-treatment chamber 11 illustrated in FIG. 4, the reflector plate 15 of fixed type as illustrated in FIG. 1 is replaced by an endless belt 35 running in the machine direction MD. The endless belt 35 is made of metallic material, heat-resistant rubber or the like and air-impervious. The jet streams of hot gas 12 directed to the non-woven fabric 1 strike on the endless belt 35 and thereupon divert the pathways thereof in a manner similar to the case of the reflector plate 15. Use of the endless belt 35 makes it possible to restrict a tensile force in the machine direction MD which otherwise would be exerted on the non-woven fabric 1 or the non-woven fabric 10 as the non-woven fabric 1 or the non-woven fabric 10 moves in the machine direction MD. In this way, the endless belt 35 makes it possible for the heat-treated non-woven fabric 10 to avoid a thickness reduction which will be caused by pulling force to the machine direction MD.

Figure 5:
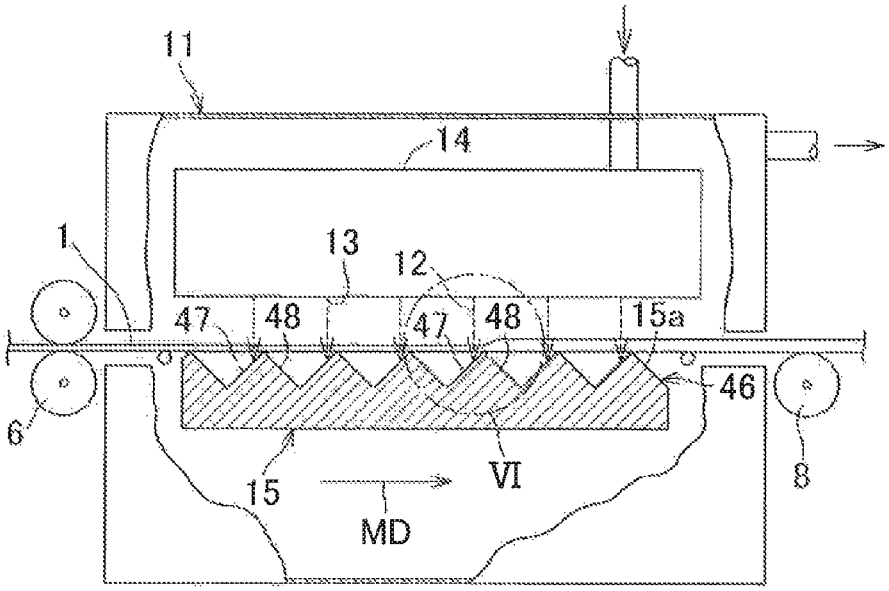
FIG. 5 is a diagram illustrating another embodiment of the heat-treatment chamber.
Figure 6:
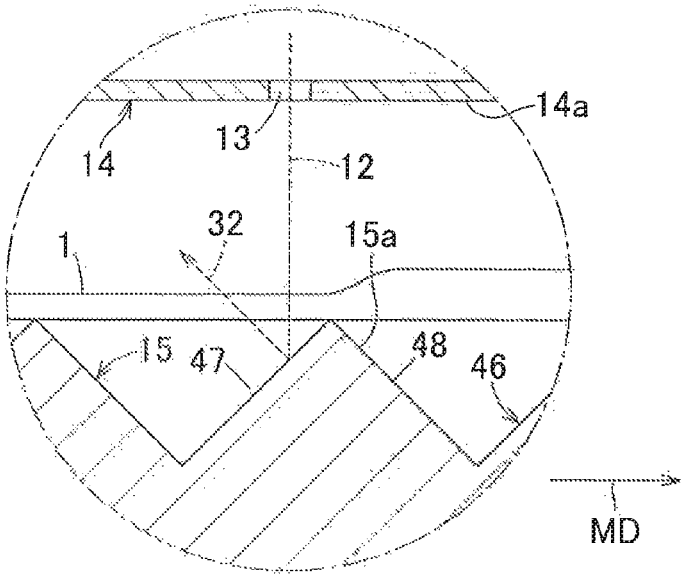
FIG. 6 is a diagram, illustrating a part of FIG. 5 in an enlarged, scale.

FIG. 5 is a diagram similar to FIG. 4 exemplarily illustrating another embodiment of the heat-treatment chamber 11 and FIG. 6 is a diagram illustrating a part of FIG. 5 in an enlarged scale. The reflector plate 15 used in the heat-treatment chamber 11 illustrated in FIG. 5 is also of the fixed type but distinguished from the heat-treatment chamber 11 illustrated in FIG. 1 in that this alternative reflector plate 15 has an upper surface 15*a* describing a zigzag line 46 in its sectional view taken in the machine direction MD. Along the zigzag line 46, first slant faces 47 defining upward slopes and second slant faces 48 defining downward slopes alternate in the machine direction MD. The jet streams of hot gas jet nozzles 13 are respectively formed so as to lie above the associated first slant faces 47. The jet streams of hot gas 12 supplied from the hot gas jet nozzles 13 are reflected by the associated first slant faces 47 to generate the reflected jet streams of hot gas 32 and at least a part thereof is directed toward upstream as viewed in the machine direction MD and thereby functions to heat the region of the non-woven fabric 1 immediately after having been introduced into the heat-treatment chamber 11. Both the first slant faces 47 and the second slant faces 48 of the reflector plate 45 extend in the cross direction CD.

Figure 7:
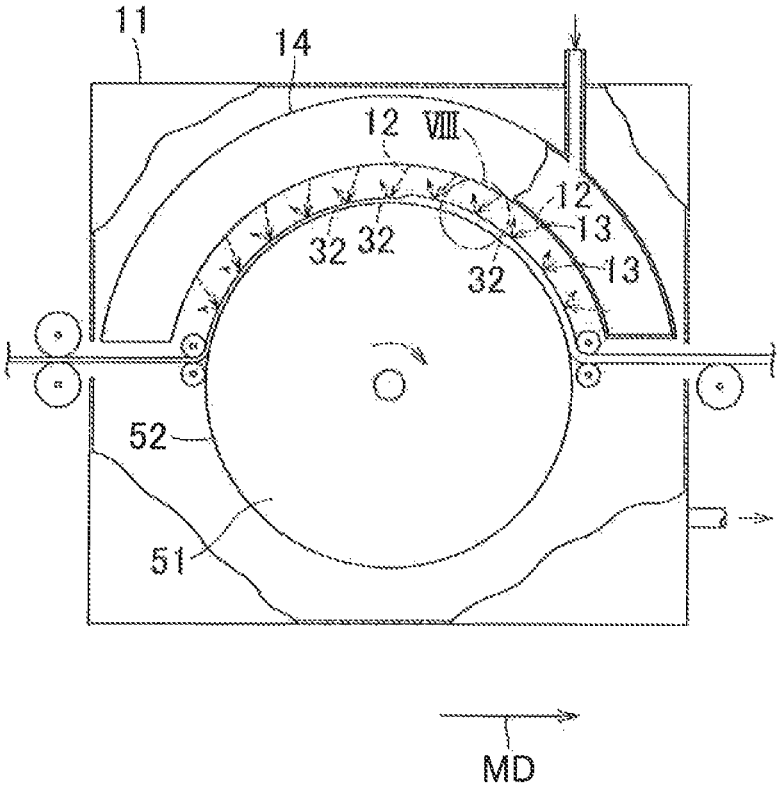
FIG. 7 is a diagram illustrating still another embodiment of the heat-treatment chamber.
Figure 8:
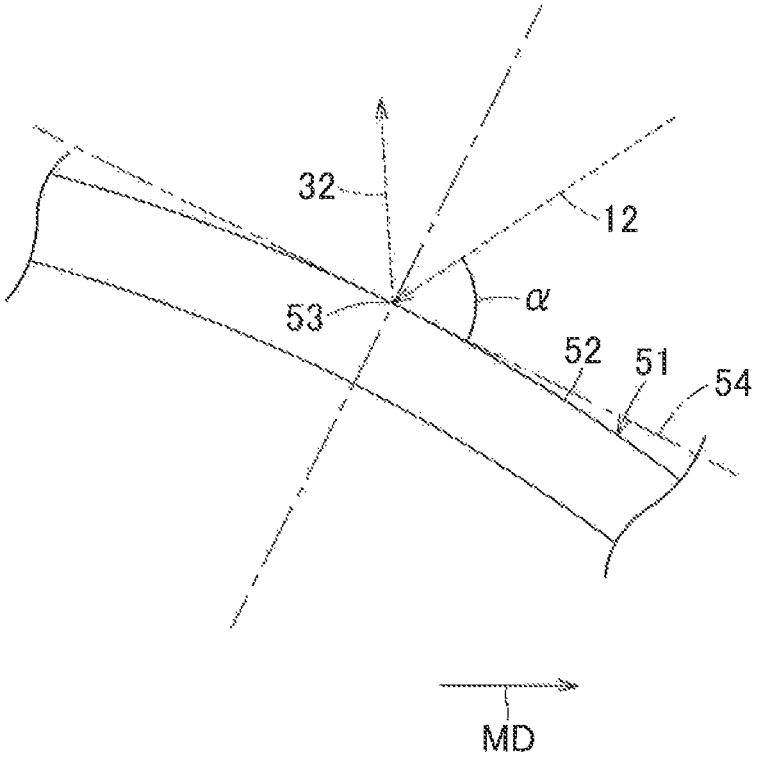
FIG. 8 is a diagram illustrating a part of FIG. 7 in an enlarged scale.

FIG. 7 is a diagram exemplarily illustrating the heat-treatment chamber 11 as an alternative to the heat-treatment chamber 11 of FIG. 1 as partially cutaway and FIG. 8 is a diagram illustrating a part of FIG. 7 in an enlarged scale. Within the heat-treatment chamber 11 of FIG. 7, a drum 51 adapted to rotate in the machine direction MD and a circular arc-shaped hot gas jet unit 14 surrounding an upper half of the drum 51. The drum 51 has an air-impervious peripheral surface 52 made of a metallic plate or a heat-resistant rubber sheet so that the jet streams of hot gas 12 supplied from the jet nozzles 13 of the unit 14 may penetrate the non-woven fabric 1 and strike on the peripheral surface 52 to generate reflected jet streams of hot gas 32. FIG. 8 exemplarily illustrates an angle at which the jet streams of hot gas 12 strike on the peripheral surface 52. Now it is assumed that the jet streams of not gas 12 go straight ahead from the jet nozzles 13 and strike on the peripheral surface 52 at a point 53 at a crossing angle $\alpha$ between the jet streams of not gas 12 and a tangent line 54 to the peripheral surface 52 at the point 53. It is possible to obtain the reflected jet streams of hot gas 32 directed to the upstream side in the machine direction MD, if the jet streams of hot gas 12 is directed so that the crossing angle $\alpha$ opening toward downstream in the machine direction MD can be an acute angle. Such reflected jet streams of hot gas 32 serve to heat the region of the non-woven fabric 1 immediately after having been introduced into the heat-treatment chamber 11 and thereby to accelerate a rise in temperature of the non-woven fabric 1.

Figure 9:
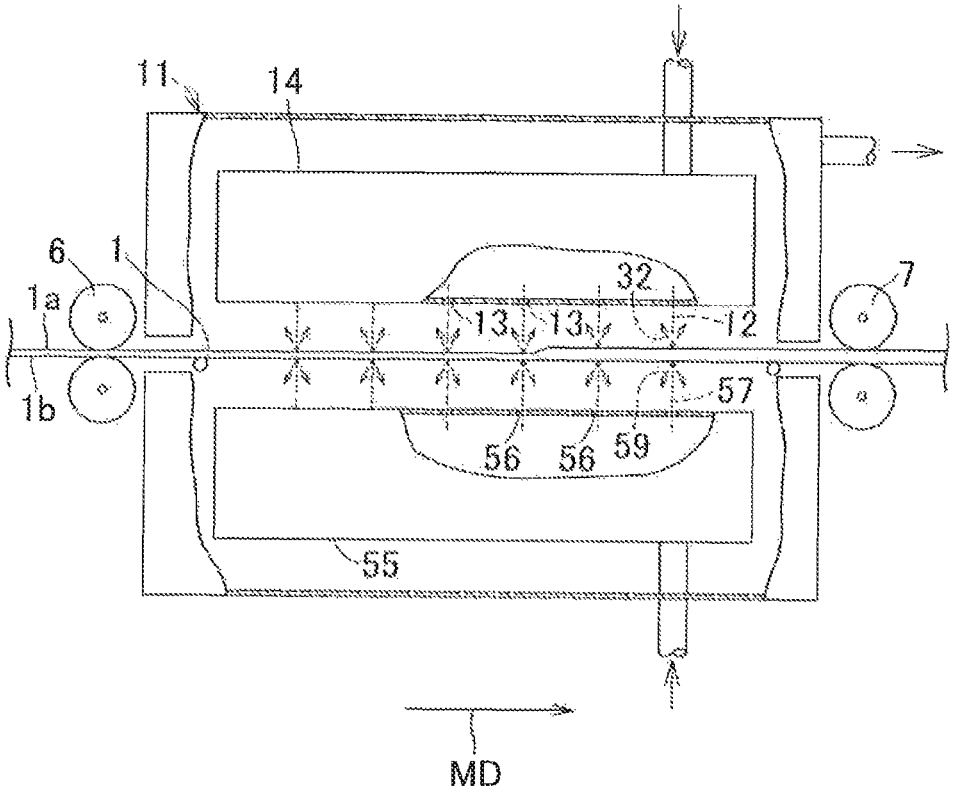
FIG. 9 is a diagram illustrating yet another embodiment of the heat-treatment chamber.

FIG. 9 also exemplarily illustrates the heat-treatment chamber 11 as another embodiment of the neat-treatment chamber 11 of FIG. 1. This alternative heat-treatment chamber 11 includes the jet streams of hot gas jet unit 14 but not the reflector plate 15. Specifically, the reflector plate 15 is replaced by a lower hot gas jet unit 55 provided, between the first nip roll pair 6 and the second, nip roll pair 7. The unit 55, in turn, includes a plurality of jet nozzles 56 for jet streams of hot gas 57 and these jet nozzles 56 are located to face the associated jet. nozzles 13 formed in the unit 14. The jet streams of hot gas 57 vertically directed toward the lower surface 1*b* of the non-woven fabric 1 to heat the non-woven fabric 1 come into collision within the non-woven fabric 1 with the jet streams of hot gas 12 supplied from the jet nozzles 13. Upon such collision, pathways of the respective jet streams of hot gas 12, 57 are diverted so as to generate reflected jet streams of hot gas 32, 58, respectively, serving to enhance the heating effect. In other words, the jet streams of hot gas 57 supplied from the unit 55 functions also as a means to divert the pathways of the jet streams of hot gas 12 coming into collision with the jet streams of hot gas 57. With respect to temperature and/or wind velocity, the jet streams of hot gas 12 and the jet streams of hot gas 57 may be different from or similar to each other. It should be appreciated that the jet streams of hot gas used to heat-treat the non-woven fabric 1 may be directed toward the lower surface 1*b* of the non-woven fabric 1 instead of directing it toward the upper surface 1*a* of the non-woven fabric 1 without departing from the scope of the invention. In view of this, it is also possible within the heat-treatment chamber 11 of FIG. 9 to utilize the jet streams of hot gas 57 as a means to heat-treat the non-woven fabric 1 and to utilize the jet streams of hot gas 12 as a means to divert the pathways of the jet streams of hot gas 57. Assumed that the jet streams of hot gas 12 are referred to as a first jet streams of hot gas and the jet nozzles 13 are referred to as first jet nozzles while the jet streams of hot gas 57 sire referred to as second jet streams of hot gas and the jet nozzles 56 are referred to as second jet nozzles, one of the first and second jet streams of hot gas 12, 57 may be used for heat-treatment and the other may be used as a means for diversion of the pathways. In FIG. 9, the nip roll pair 7 exemplarily illustrated in. FIG. 1 is located upstream in the machine direction MD. In the process as illustrated in FIG. 9, there may be provided additional nip roll pair (s) and/or feed roll(s), if it is desired.

Figure 10:
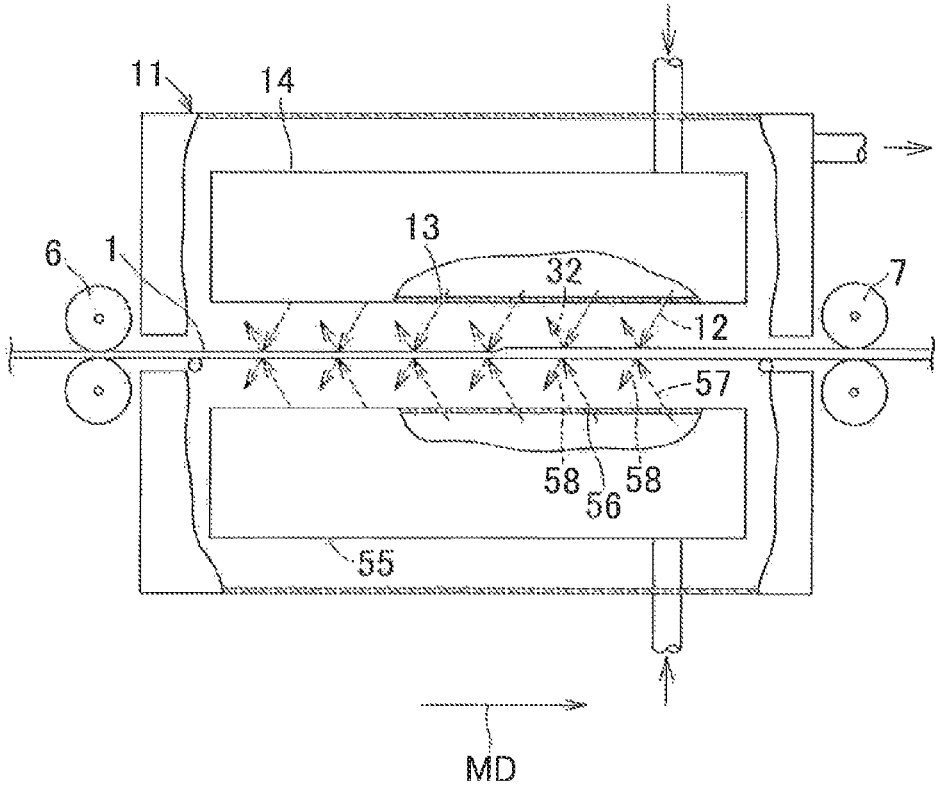
FIG. 10 is a diagram illustrating further another embodiment of the heat-treatment chamber.

FIG. 10 is a diagram similar to FIG. 9, exemplarily illustrating still another alternative to that of FIG. 1. With reference to FIG. 10, while the jet nozzles 13 in the hot gas jet unit 14 are opposed to the associated jet nozzles 56 in the lower hot gas jet unit 55, the jet streams of hot gas 12, 57 supplied from the respective jet nozzles 13, 56 are directed obliquely toward the upper surface 1*a* and the lower surface 1*b* respectively and toward upstream in the machine direction MD so as to come into collision with one another within the non-woven fabric 1 and to generate the reflected jet streams of hot gas 32, 58. Thereupon, most of the reflected jet streams of hot gas 32, 58 have pathways diverted so as to be directed toward upstream in the machine direction MD and thereby to enhance heating of the region of the non-woven fabric 1 immediately after having been introduced into the heat-treatment chamber 11.

Figure 11:
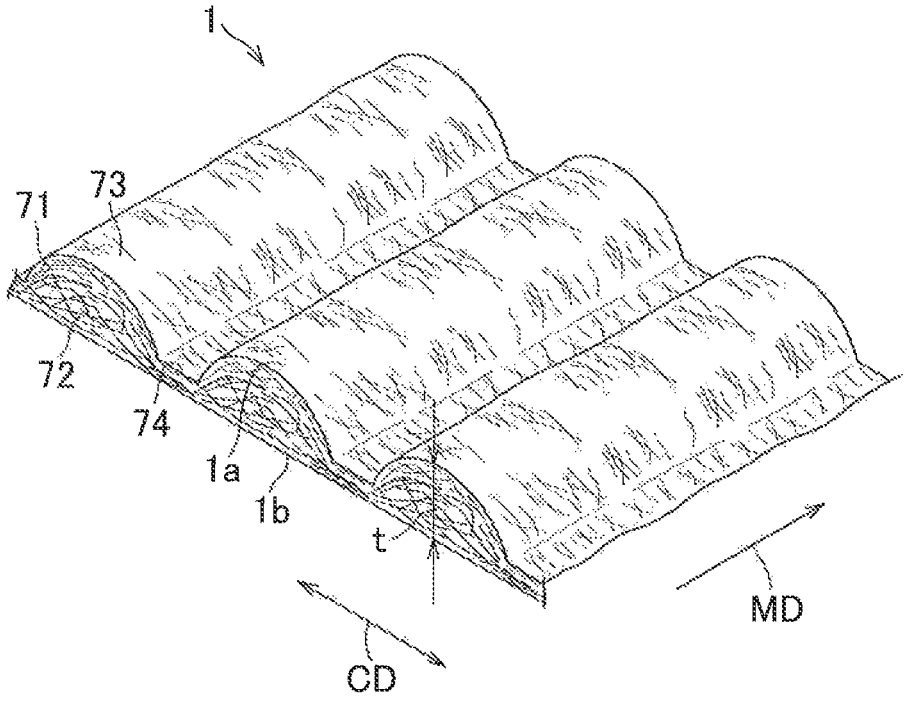
FIG. 11 is a perspective view of non-woven fabric.

FIG. 11 is a perspective view exemplarily showing the non-woven fabric 1 having been used to implement the present invention and demonstrating the effect of the invention achieved by the process of FIG. 1. The non-woven fabric 1 has a transverse direction, a longitudinal direction and a thickness direction which are orthogonal one to another and, in FIG. 11, the transverse direction corresponds to the cross direction CD and the longitudinal direction corresponds to the machine direction MD. The non-woven fabric 1 has an upper surface 1*a* and a lower surface 1*b* both extending in the transverse direction and the longitudinal direction, i.e., extending in one cross direction CD and the machine direction MD. The non-woven fabric 1 is a laminated web comprising a web including the upper surface 1*a* and forming an upper layer 71 and a web including the lower surface 1*b* and forming a lower layer 72 wherein, the laminated web has crests 73 and troughs 74 extending in parallel one to another in the machine direction MD and alternate in the cross direction CD which is orthogonal to the machine direction MD. The upper layer web 71 is made of carded web comprising coaxial core/sheath type composite fibers consisting of high density polyethylene (melting point of 135° C.) as the sheath and polyethylene terephthalate as the core and, as a whole, having a fineness of 3.3 dtex and a fiber length of 38 mm, on one hand, and eccentric core/sheath composite fibers consisting of high density polyethylene (melting point of 135° C.) as the sheath and polyethylene terephthalate as the core and, as a whole, having a fineness of 2.6 dtex and a fiber length of 38 mm, on the other hand. These two types of composite fibers are mixed with each other at a mass ratio of 85:15 to form a carded web having a basis mass of 20 g/m$^2$ and a width dimension of approximately 75 mm. The lower layer web 72 is made of a carded web comprising coaxial core/sheath type composite fibers consisting of high density polyethylene smelting point of 135° C.) as the sheath and polyethylene terephthalate as the core and, as a whole, having a fineness of 3.3 dtex and a fiber length of 51 mm, on one hand, and eccentric core/sheath composite fibers consisting of high density polyethylene (melting point of 135° C.) as the sheath and polyethylene terephthalate as the core and, as a whole, having a fineness of 2.6 dtex and a fiber length of 38 mm, on the other hand. These two types of composite fibers are mixed with each other at a mass ratio of 85:15 to form a carded web having a basis mass of 15 g/m$^2$ and a width dimension of approximately 75 mm, The laminated web consisting of the upper layer 71 and the lower layer 72 is fed in the machine direction MD and, in the course of being fed, jet air applied to the upper layer 71 from a plurality of nozzles (not shown) arranged in the cross direction CD to form the laminated web with crests 73 and troughs 74 as illustrated. Thereafter, the laminated web is introduced into a heating chamber set at 135° C. and thereby the eccentric core/sheath type composite fibers are crimped and high density polyethylene is melted so that two types of composite fibers can be welded together in regions where these two types of composite fibers are in contact one with another. Finally, the laminated web is cooled, taken up in the form, of a roll, left in this state at a room temperature for 30 days and thereafter such laminated web taken up in the form of a roll is used as the roll 2 of the non-woven fabric 1.

During the process as schematically illustrated in FIG. 1, the web of the non-woven fabric 1 as shown in FIG. 11 is fed from the roll 2 to the heat-treatment chamber 11 within which the non-woven fabric 1 is moved in the machine direction MD at a velocity of 100 m/min or 200 m/min. The hot gas jet unit 14 is provided with three hundred twenty three (323) hot gas jet nozzles 13 each having a diameter of 0.5 mm, specifically, nineteen (19) hot gas jet nozzles 13 arranged in the machine direction MD at a pitch of 20 mm and similar seventeen (17) hot gas jet nozzles 13 arranged in the cross direction CD at a pitch of 5 mm. The unit 14 is set up so that the bottom wall 14*b* thereof is spaced upward from the upper surface 1*a* of the non-woven fabric 1 by 5 mm as measured at upstream in the machine direction.

TABLE 1 indicates changes in the thickness t of the non-woven fabric 1 shown in FIG. 11 observed before and after the heat-treatment. To measure the thickness t of the non-woven fabric 1 immediately after fed from the roll 2 and the thickness t of the non-woven fabric 10 having passed through the cold air jet unit 17, twenty sheets of the non-woven fabric each having a length of 200 mm and a width of 70 mm were layered one on another, these layered non-woven fabric sheets were placed on a horizontal table, a flat plate having a length of 240 mm and a width of 80 mm was placed on the layered non-woven fabric sheets and a mass was placed on the plate. A total load, of the mass and the plate was set at 76.8 g. One minute after such total load had been applied, a thickness t of the layered non-woven fabric sheets was measured for each sample by using a slide caliper and the measured values for the respective examples were indicated in TABLE 1 as "thickness of non-woven fabric".

The non-woven fabric 1 was heat-treated within the heat-treatment chamber 11 without using the reflector plate 15 to obtain sheets of non-woven fabric as controls. For the non-woven fabric sheets used, as the respective controls also, twenty sheets of non-woven fabric were layered one on another and the thickness of the layered non-woven fabric sheets was indicated in TABLE 1 as the thickness of the non-woven fabric.

TABLE 1

| | Feeding rate (m/min) | Type of jet streams of hot gas | Temperature of jet streams of hot gas (° C.) | Reflector plate | Thickness of non-woven fabric (mm) Before heat-treatment | After heat-treatment |
|---|---|---|---|---|---|---|
| Example 1 | 100 | Steam | 130 | Adopted | 14 | 48 |
| Example 2 | 200 | Steam | 130 | Adopted | 14 | 43 |
| Control 1 | 100 | Steam | 130 | Not adopted | 14 | 40 |
| Control 2 | 200 | Steam | 130 | Not adopted | 14 | 37 |

IDENTIFICATION OF REFERENCE NUMERALS USED IN THE DRAWINGS

1 web of non-woven fabric
1*a* upper surface
1*b* lower surface
2 roll
6 first roll pair
7 second roll pair
11 heat-treatment chamber
12 jet streams of hot gas (first jet streams of hot gas)
13 hot gas jet nozzles
15 diverting means for first jet streams of hot gas (fixed plate)
20 thermoplastic synthetic fibers
35 diverting means for jet streams of hot gas (belt)
51 roll
52 peripheral surface
56 hot gas jet nozzles
57 diverting means for jet streams of hot gas (second jet streams of hot gas)
t thickness
MD machine direction
CD cross direction

The invention claimed is:

1. A method of increasing a thickness of a non-woven fabric, said method comprising:

feeding a web of non-woven fabric in a machine direction, wherein said non-woven fabric includes a mess of thermoplastic synthetic fibers entangled one with another, has transverse direction, a longitudinal direction and a thickness direction being orthogonal one to another, and upper and lower surfaces opposite to each other in said thickness direction, and extends in said transverse direction as well as in said longitudinal direction; and applying first jet streams of hot gas in said thickness direction to said web of non-woven fabric while said web is being in said machine direction to increase said thickness of said non-woven fabric, wherein a temperature of said first jet streams of hot gas is lower than a temperature at which thermoplastics forming a surface of said thermoplastic synthetic fibers begin to melt; and said applying said first jet streams of hot gas farther comprises:

heating said non-woven fabric by applying said first jet streams of gas on one surface of said upper and lower surfaces of said non-woven fabric in a single direction so that said first jet streams of hot gas penetrate fiber interstices formed of said mass of thermoplastic synthetic fibers; and striking said first jet streams of hot gas against a stream diverting member, said stream diverting member being in direct contact with the non-woven fabric so that pathways of said first jet streams of hot gas are diverted by the stream diverting member so as to cause said first jet stream of hot gas to heat said non-woven fabric further and thereby to increase said thickness of said non-woven fabric.

2. The method according to claim 1, wherein said stream diverting member comprises one of an air-impervious fixed plate slidably supporting said web of said non-woven fabric from said lower surface thereof in said machine direction, an air-impervious belt being movable in said machine direction together with said web of non-woven fabric supported thereon, and an air-impervious peripheral surface of a roll adapted to rotate in said machine direction.

3. The method according to claim 1, wherein said first jet streams of hot gas comprise one of dry air and water steam.

4. The method according to claim 1, wherein said web of said non-woven fabric is fed from a roll of said web of non-woven fabric.

5. The method according to claim 1, wherein the temperature of said first jet streams of hot gas is between a melting temperature of the thermoplastics forming the surface of said thermoplastic synthetic fiber and the temperature lower than said melting temperature by 30° C.

6. An apparatus for implementing said method according to claim 1, said apparatus comprising:

said stream diverting member being formed of one of (i) an air-impervious fixed plate slidably supporting said non-woven fabric from said lower surface thereof, (ii) an air-impervious belt being movable in said machine direction together with said non-woven fabric supported thereon, and (iii) an air-impervious peripheral surface of a roll adapted to rotate in said machine direction; and first jet nozzles configured to apply first jet streams of hot gas to said non-woven fabric supported by one of (i) said fixed plate, (ii) said belt and (iii) said peripheral surface, and thereby to make said first jet streams of hot gas strike against said stream diverting member.

7. The apparatus according to claim 6, wherein the distance between said first jet nozzles and said one of (i) said air-impervious fixed plate, (ii) said air-impervious belt and (iii) said air-impervious peripheral surface of said roll is gradually increased toward the downstream in the machine direction.

8. The apparatus according to claim 6, wherein said one of (i) said air-impervious fixed plate, (ii) said air-impervious belt and (iii) said air-impervious peripheral surface of said roll is configured to be heated independently.

9. The apparatus according to claim 6, wherein said one of (i) said air-impervious fixed plate, (ii) said air-impervious belt and (iii) said air-impervious peripheral surface of said roll has a surface describing a zigzag line in a sectional view taken in the machine direction.

10. The apparatus according to claim 6, wherein said first jet nozzles have one of an arrangement-including a plurality of circular jet nozzles aligned in the machine direction, and an arrangement including a plurality of circular jet nozzles aligned in said machine direction as well as in the cross direction orthogonal to said machine direction.

11. The apparatus according to claim 6, wherein said first jet nozzles are one of openings elongated in said machine direction and parallel one with another, and openings elongated in a cross direction orthogonal to said machine direction and parallel one with another.

12. A method of increasing a thickness of a non-woven fabric, wherein said method comprises:

feeding a web of non-woven fabric in a machine direction, wherein said non-woven fabric includes a mass of thermoplastic synthetic fiber entangled one with another, has a transverse direction, a longitudinal direction and a thickness direction being orthogonal one to another, and upper and lower surfaces opposite to each other in said thickness direction, and extends in said transverse direction as well as in said longitudinal direction; and applying first jet streams of hot gas in said thickness direction to said web of non-woven fabric while said web is being fed in said machine direction to increase said thickness of said non-woven fabric, wherein a temperature of said first jet streams of hot gas is lower than a temperature at which thermoplastics forming a surface of said thermoplastic synthetic fibers begin to melt; and said applying said first jet streams of hot gas further comprises:

heating said non-woven fabric by applying said first jet streams of hot gas on said one surface of said upper and lower surface of said non-woven fabric is a single direction so that said first jet streams of hot gas penetrate fiber interstices formed of said mass of thermoplastic synthetic fibers; and striking said first jet streams of hot gas against second jet stream of hot gas to divert pathways of said first jet streams of hot gas so as to cause said first jet stream of hot gas to heat said non-woven fabric further and thereby to increase said thickness of said non-woven fabric, wherein said second jet stream of hot gas are applied to the surface opposite to said one surface to which said first jet streams of hot gas is applied.

13. The method according to claim 12, wherein said first jet streams of hot gas are directed obliquely toward said one surface of said non-woven fabric and toward an upstream side in said machine direction, and said second jet streams of hot gas are directed obliquely toward the other, opposite surface of said non-woven fabric and toward upstream side in said machine direction.

14. An apparatus for implementing the method according to claim 12, said apparatus comprising:

first and second roll pairs spaced from each other in said machine direction and configured to feed said non-woven fabric in said machine direction; and between said first and second roll pairs, first jet nozzles configured to apply first jet streams of hot gas to said one surface of said upper and lower surfaces of said non-woven fabric, and second jet nozzles configured to apply second jet streams of hot gas to the surface opposite to said one surface, wherein a direction in which said first jet nozzles extend and a direction in which said second jet nozzles extend are configured to make said first jet streams of hot gas and said second jet streams of hot gas come into collision with each other within said non-woven fabric.

15. A method of increasing a thickness of a non-woven fabric, said method comprising:

feeding a web of non-woven fabric in a machine direction, wherein said non-woven fabric includes a mass of thermoplastic synthetic fibers entangled one with another, has a transverse direction, a longitudinal direction and a thickness direction being orthogonal one to another, and upper and lower surfaces opposite to each other in said thickness direction, and extends in said transverse direction as well as in said longitudinal direction; and applying first jet streams of hot gas in said thickness direction to said web of non-woven fabric while said web is being fed in said machine direction to increase said thickness of said non-woven fabric, wherein a temperature of said first jet streams of hot gas is lower than a temperature at which thermoplastics forming a surface of said thermoplastic synthetic fibers begin to melt; and said applying said first jet streams of hot gas further comprises:

heating said non-woven fabric by applying said first jet streams of hot gas on one of said upper and lower surfaces of said non-woven fabric in a single direction so that said first jet streams of hot gas penetrate fiber interstices formed of said mass of thermoplastic synthetic fiber; and striking said first jet streams of hot gas against a stream diverting member to reflect said first jet streams of hot gas and make said first jet streams of hot gas heat said non-woven fabric further and thereby to increase said thickness of said non-woven fabric;

wherein said stream diverting member comprises one of an air-impervious fixed plate slidably supporting said web of said non-woven fabric from said lower surface thereof in said machine direction, an air impervious belt being movable in said machine direction together with said web of non-woven fabric supported thereon, and an air-impervious peripheral surface of a roll adapted to rotate in said machine direction.

* * * * *